US006083890A

United States Patent [19]

Miskiel et al.

[11] Patent Number: 6,083,890

[45] Date of Patent: Jul. 4, 2000

[54] ACIDIC CLEANING COMPOSITIONS CONTAINING LOW ACETATE XANTHAN GUM

[75] Inventors: Frank Miskiel, San Diego, Calif.; Yogesh Solanki, Sanderstead, United Kingdom

[73] Assignee: Monsanto Company, St. Louis, Mo.

[21] Appl. No.: 08/870,378

[22] Filed: Jun. 6, 1997

Related U.S. Application Data

[63] Continuation of application No. 08/660,758, Jun. 6, 1996, abandoned.

[51] Int. Cl.[7] ..... C11D 3/22; C11D 7/08

[52] U.S. Cl. ..... 510/108; 510/191; 510/238; 510/239; 510/245; 510/253; 510/405; 510/434; 510/470; 510/477; 510/488; 134/3; 134/41

[58] Field of Search ..... 510/191, 238, 510/239, 108, 245, 405, 253, 434, 477, 488, 470; 134/3, 41

[56] References Cited

U.S. PATENT DOCUMENTS

| | | | |
|---|---|---|---|
| 3,020,206 | 2/1962 | Patton et al. | 195/31 |
| 3,020,207 | 2/1962 | Patton | 195/31 |
| 3,096,293 | 7/1963 | Jeanes et al. | 252/316 |
| 3,391,060 | 7/1968 | McNeely | 195/31 |
| 3,964,972 | 6/1976 | Patton | 195/31 P |
| 3,993,575 | 11/1976 | Howanitz et al. | 252/142 |
| 4,154,654 | 5/1979 | Campagne | 195/31 P |
| 4,214,912 | 7/1980 | Racciato et al. | 106/208 |
| 4,302,253 | 11/1981 | Ciullo | 106/208 |
| 4,340,678 | 7/1982 | Wernau | 435/253 |
| 4,352,882 | 10/1982 | Maury | 435/101 |
| 4,369,125 | 1/1983 | Kragen et al. | 252/316 |
| 4,375,512 | 3/1983 | Richmon | 435/104 |
| 4,532,066 | 7/1985 | Paszek et al. | 252/144 |
| 4,676,920 | 6/1987 | Culshaw | 252/163 |
| 4,767,563 | 8/1988 | de Buzzaccarini | 252/174.25 |
| 4,787,998 | 11/1988 | Rennie et al. | 252/174.11 |
| 4,824,589 | 4/1989 | Magyar et al. | 134/41 |
| 4,855,069 | 8/1989 | Schuppiser et al. | 510/238 |
| 4,873,323 | 10/1989 | Cros et al. | 536/114 |
| 4,885,069 | 12/1989 | Schuppiser et al. | 106/208 |
| 5,368,843 | 11/1994 | Rennie | 424/49 |
| 5,409,630 | 4/1995 | Lysy et al. | 510/401 |
| 5,441,773 | 8/1995 | Rodzewich | 427/388.4 |

FOREIGN PATENT DOCUMENTS

| | | |
|---|---|---|
| 0233110 | 8/1987 | European Pat. Off. . |
| 0241779 | 10/1987 | European Pat. Off. . |
| 0255405 | 2/1988 | European Pat. Off. . |
| 0255405 | 3/1988 | European Pat. Off. . |
| 0589761 | 3/1994 | European Pat. Off. . |
| 2182339 | 5/1987 | United Kingdom . |
| 8705939 | 8/1987 | WIPO . |
| 8705939 | 10/1987 | WIPO . |

OTHER PUBLICATIONS

Research Disclosure 36151, May 1994, No. 361, p. 271.

"Kelzan in Cleaners", Kelco Company Technical Bulletin, I#20, 140/00534, 2/71.

"Research Disclosure", Aug. 1994, No. 364, #36417, Established 1960, pp. 403–449.

"Research Disclosure", May 1994, No. 361, #051 (#151), Established 1960, pp. 233–280.

"Optical Rotation Behavior of Xanthan in Mixtures of Water and Cadoxen", Carbohydrate Polymers 5, Hiroko Kitagawa, et al., (Apr. 21, 1985), pp. 407–422.

"Acid Hydrolysis and High–Performance Liquid Chromatography of Xanthan", Carbohydrate Polymers 13, M.I. Tait, and I.W. Sutherland, (1990), pp. 133–148.

"Location of a Second o–Acetyl Group in Xanthan Gum by the Reductive–Cleavage Method", Carbohydrate Research, 241, John D. Stankowski et al., (1993) pp. 321–326.

*Primary Examiner*—Lorna M. Douyon

*Attorney, Agent, or Firm*—Fitzpatrick, Cella, Harper & Scinto

[57] ABSTRACT

An improved acidic cleaning composition comprising a low acetate xanthan gum as a rheological control agent exhibits greater, longer lasting stability and shelf-life than acidic cleaning compositions with xanthan gum have exhibited in the past.

21 Claims, No Drawings

ACIDIC CLEANING COMPOSITIONS CONTAINING LOW ACETATE XANTHAN GUM

CROSS REFERENCE TO RELATED APPLICATIONS

This is a continuation-in-part of U.S. application No.08/660,758 filed Jun. 6, 1996, entitlec "acidic cleaners containing xanthan gum" now abandoned.

The invention relates generally to acidic cleaning compositions (cleaners) useful for the removal of "soils" such as limescale deposits from ceramic, plastic, enamel, chrome, metals and other like surfaces. In particular, the present invention relates to acidic cleaning compositions containing a thickener (rheological modifier) for improved surface coating and adherence, body, ease of use and anti-sedimentation functionalities required in some cleaning applications.

BACKGROUND OF THE INVENTION

Acidic, neutral and alkaline cleaning compositions have been used for many years for removing soils such as grease, inorganic deposits and stains and the like from hard surfaces and the like. Acidic cleaning compositions are also efficient in the removal of limescale deposits from toilet bowls, baths, sinks and taps, provided that such cleaners are kept for sufficient time and in physical contact with the soil to be removed. Such deposits generally build up in instances where the water is hard. As calcium and magnesium salt deposits become caked onto these surfaces they become extremely difficult to remove.

And, too, the surfaces to which such cleaners may be applied are often vertical, inclined or irregularly shaped. Low viscosity liquid acidic cleaners may drip and sometimes run from such surfaces when applied thereto. As a result, the liquid acid cleaning composition may not have sufficient contact time or sufficiently close physical proximity with the surface and soil to work well or fully and thus fail to achieve the desired degree of removal of the limestone deposit or other soil. This presents a problem of inadequate cleaning.

In an effort to provide a solution to these liquid run-off and inadequate cleaning problems, rheology modifiers have been added to liquid acidic cleaners to thicken and give body to them. Increasing the viscosity of the cleaner enables it to be applied to the surface with reduced dripping and run-off so that the acid cleaner may have a longer contact time with the soiled surface being treated. The rheological properties of the resulting composition must also be such as to enable the cleaner composition to be filled into a bottle, trigger-pack or other suitably convenient container and thereafter to be applied to the soiled surface through an opening in the container, such as a spout, nozzle or spray device that facilitates uniform distribution onto easy-, moderate- and hard-to-reach surfaces. The rheological properties must also be such as to readily enable rinsing off the surface with water or wiping the surface with a sponge or cloth after the cleaning effect has been achieved so it is complete.

Some water-soluble polymers or hydrocolloids are useful as rheology modifiers in a wide variety of applications. These generally will hydrate and dissolve when dispersed in water to produce viscous solutions or gels. Illustrative but non-limiting types of hydrocolloid useful in this manner include natural polysaccharides, polysaccharide derivatives and synthetic polymers and the like. Specific non-limiting examples include guar gum, carob gum, carrageenan, alginate, carboxymethyl cellulose, hydroxyethyl cellulose and other cellulose derivatives, and polyacrylates. Biosynthetic gums are high molecular weight polysaccharides produced by the fermentation of a carbohydrate by a bacterium or other microorganism. In particular, these include the Xanthomonas as well as bacterial species of the genus Sphingomonas, Bacillus, Arthrobacter, Azotobacter, Klebsiella, Agrobacterium, Pseudomonas, Rhizobium and Sclerotium.

Xanthan gum is a biosynthetic gum produced by the fermentation of carbohydrate by a culture of *Xanthomonas campestris*. The fermentation process as well as the isolation and purification of the gum is set forth in U.S. Pat. No. 4,352,882 to Lucien G. Maury, which issued on Oct. 5, 1982, and U.S. Pat. No. 4,375,512 to Joe B. Richman, which issued on Mar. 1, 1983, each of which and both of which are hereby incorporated by reference in their entirety.

Xanthan gum is well known as a rheology modifier in a wide variety of applications. The rheological properties of xanthan gum in aqueous compositions, in particular its high degree of pseudoplastic shear-thinning character, make it well suited to applications in acidic cleaners. Under conditions of rest or low shear, an acidic cleaner containing xanthan gum exhibits a very high viscosity, thus giving effective surface adherence, resistance to run-off and suspension of any abrasive particles which may be incorporated in the cleaner. Under conditions of high shear, the cleaner exhibits a low viscosity, thus making it easy to fill into and apply from the container and easy to remove from the surface after the cleaning action has taken place.

Kelco Company Technical Bulletin I#20, published in February 1971, referred to the ability of xanthan gum, when incorporated in a wide range of cleaners from strong caustic types to acidic products, to impart the property of cling to inclined surfaces so that long contact time can be maintained.

U.S. Pat. No. 4,787,998, which issued to George K. Rennie and Paul D. Hardman on Nov. 29, 1988, discloses a fragrant liquid cleaning composition containing a shear-thinning polymer, such as xanthan gum, having viscosities within defined ranges at specific shear rates. That patent further discloses at column 1, lines 60–68 and column 2, lines 1–3 that:

> The polymer should furthermore be compatible with the surface-active agents present in the cleaning composition. Suitable examples of polymers to be used according to the present invention are biopolymers such as the xanthan gums and derivatives thereof, such as Kelzan S, a partially acetylated xanthan gum ex Kelco Co., Shell-flo-XA ex Shell Chemicals Ltd, Enorflo-XA ex Shell Chemicals, Rhodapol ex Rhône-Poulence, cross-linked polyacrylates, such as Carbopol ex B. F. Goodrich Co. Ltd, succinoglucane, such as Shellflo-S ex Shell Chemicals Ltd, acrylic copolymers such as E.P. 1996 ex National Adhesives and Resins Ltd.

Further, that patent discloses at column 2, lines 4–13, that:

> The amount of polymer used in the cleaning composition generally ranges from 0.1–3.0%, usually from 0.25–1.0%, and preferably from 0.4–0.8 by weight. The liquid cleaning composition comprises furthermore as essential ingredients one or more detergent active materials which can be anionic, nonionic and zwitterionic type detergent actives or mixtures thereof. Usually anionic synthetic detergents, such as the alkylbenzene sulphonates, alkanesulphonates, alkylsulphates, alkylethersulphates or mixtures thereof can be used.

Research Disclosure RD-36417 published Feb. 16, 1994 discloses melamine resins, especially methylated melamine formaldehyde resins, are added to acid cleaners containing xanthan gum as the viscosifier in order to partially crosslink the gum and provide improved low shear rate viscosity over time. The resin is used in the range of 0.2–1.05 by weight of the acid cleaner, the effective level depending on the gum concentration and the type of acid.

United Kingdom Patent No. GB 2 182 339A to Avent Medical Limited, which published on May 13, 1987, discloses:

> A buffered thickening agent, for use in cleansing lotions or in topically applied medicaments or cosmetics, comprises a naturally occurring gum, such as a Xanthan gum, and an orthophosphate buffer. The buffer thus acts to increase the viscosity of the gum in use so that higher ionic concentrations can be tolerated without destabilisation of the emulsion when the buffered thickening agent is formed into a lotion. Preferably the buffered agent constitutes 0.5% to 2% by weight of an oil-in-water protective cleansing lotion which may also comprise 10% to 20% by weight of petrolatum.

U.S. Pat. No. 3,993,575 to Joseph Howanitz et al., which issued on Nov. 23, 1976, discloses:

> An acid cleaner and brightener concentrate composition comprising a dicarboxylic acid, an amine and water having a pH of about 1 to about 3 is useful in removal of tenacious soil, such as tarnish, discoloration, corrosion and oxidation products from vehicles, such as railroad rolling stock, without subsequent harm to surfaces, including coated polycarbonate glass substitute.

Although xanthan gum is well known as a rheology modifier in cleaners, characteristically the viscosity decreases undesirably over time at low pH, within about seven days after making the compositions. The extent to which the viscosity decreases is dependent on a number of factors, such as the pH and ionic strength of the cleaner and the pH levels, and the temperature of the acidic cleaner composition at which it is stored. In compositions stored at ambient temperature, xanthan gum loses a significant proportion, perhaps greater than about 20% or more, of its viscosifying functionality within an acidic composition in about seven days at a pH of about 2.2 or less. This may eventually lead to product performance disappointment and failure unless an increased concentration of xanthan gum is initially used to compensate for the decrease in viscosity. But this increased concentration may increase the production cost of the cleaner, and may render it more difficult to manufacture on account of the higher initial viscosity.

U.S. Pat. No. 4,302,253 to Peter A. Ciullo, which issued Nov. 24, 1981, discloses cleaning compositions consisting of a solution of mineral acid such as hydrochloric or formic acid thickened with a clay, xanthan gum and imidazoline. The imidazoline appears to function as an anti-flocculating agent for the clay and allegedly affords the composition some stability. However, the components may render the product cost sensitive.

U.S. Pat. No. 4,855,069 to Schuppiser et al., which issued Aug. 8, 1989, discloses aqueous acid compositions thickened by a polysaccharide for use particularly in the cleaning of surfaces. The compositions are stabilized against loss of viscosity during storage by the addition of a salt of a strong base and an acid having a pK equal or greater than 2. The stabilization results from an increase in the pH of the composition. It necessitates the incorporation of a significant quantity of an additional chemical, such as tri-sodium phosphate, in the cleaner. This has the disadvantages of increasing the production cost and environmental impact. This patent discloses at column 21, lines 49–59 that:

> The designation "xanthan gum" includes treated and modified materials, such as deacetylized xanthan gum, depyruvatized xanthan gum, xanthan gum cross-linked with polyvalent cations, the gum/glyoxal complexes, and the like. In the compositions of the invention, one gum or a mixture of gums may be used. It is known that within certain proportions, mixtures of gums possess a synergy in regard to viscosifying and/or gelling capability. Thus, synergism may be used to advantage in the compositions of the invention.

and further, column 3, lines 61–65 that:

> The compositions may be prepared in any manner desired by mixing the various additives in water. It is desirable to initially disperse and dissolve the polysaccharide in water and then add the acid and finally the salt.

Research Disclosure 36151 (May 1994, p. 271) discloses a process for producing a pre-degraded xanthan gum product which can be used for acid cleaner formulations where 100% viscosity stability is required. The process involves treatment of xanthan gum broth with hydrochloric acid. After a specified period, the broth is neutralized with a stoichiometric amount of sodium hydroxide and then pasteurized and further processed as normal. The disadvantage of this process is that the pre-degraded xanthan gum has a significantly reduced viscosifying ability and needs to be used at a relatively high concentration, thus increasing the production cost of the cleaner.

It would be advantageous if a xanthan gum product existed which had enhanced stability in acidic compositions over time. It would be advantageous if an acid cleaner could be formulated using xanthan gum at a concentration similar to that used in neutral pH cleaners of similar rheological properties, obviating the need to add another or other chemicals in order to stabilize the xanthan gum and composition against unacceptable decrease in viscosity during the shelf life of the acidic cleaning composition.

OBJECTS OF THE INVENTION

It is an object of the present invention to provide an improved liquid (aqueous) acidic cleaning composition for the effective removal of limescale deposits and other soils from ceramic, plastic, enamel, chrome, stainless steel and other like surfaces. It is a particular object of the present invention to provide an improved acidic cleaning composition with enhanced viscosity and stability using low acetate xanthan gum as an effective rheology modifier. It is of most particular interest to provide a stable, viscous, acid-based toilet bowl cleaner utilizing low acetate xanthan gum as a rheology modifier. These and other objects of the invention are met in the process of this invention which is described in more particularity hereinafter.

BRIEF SUMMARY OF THE INVENTION

This invention comprises an improved acid cleaning composition comprising low acetate xanthan gum as a rheology modifier which exhibits better viscosity shelf-life stability than acid cleaning compositions with xanthan gum have exhibited in the past.

DETAILED DESCRIPTION OF THE INVENTION

Xanthan gum is a heteropolysaccharide of high molecular weight, composed of D-glucose, D-mannose and D-glucuronate moieties in a molar ratio of 2:2:1 respectively. The term "native xanthan gum", as used in the present context, refers to the heterpolysaccharide which has undergone no chemical modification. Preferably it is produced in agitated culture by a strain of Xanthomonas and a base medium containing an appropriate carbon or energy source, protein or amino acid, or other nitrogen (organic or inorganic) source, nutrients, and sufficient vitamins, minerals, and co-factor required for growth, as has been described in numerous publications and patents previously (compare, for example U.S. Pat. Nos. 3,020,206, 3,020,207, 3,391,060, and 4,154,654). Upon completion of the process of fermentation, the resultant broth normally contains 10 to 150 g/liter of native xanthan gum, and its pH advantageously ranges from approximately 5.0 to 8.0. The broth is then usually heat-treated at a temperature of 50° C. to 100° C. for 5 to 60 minutes. Xanthan gum is then usually recovered from the broth by adding a precipitating agent, for example isopropanol, separating, drying and milling to a powder.

Native xanthan gum typically contains approximately 5% acetate and about 4% pyruvate by weight and without being bound by theory; the acetate group ($CH_3COO$) is believed present as the ester of the primary alcohol group of the side-chain mannose residue adjacent to the main chain of the hetero-polysaccharide molecule. The acetate content (% based on solids) is typically determined by hydrolyzing the xanthan gum under acidic conditions, subjecting the hydrolyzate to exclusion chromatography, and analyzing by a chemically suppressed conductivity detection method or equivalents. Pertinent analytical articles disclosing methods for determining acetate content include:

N. W. H. Cheetham and A. Punruckvong, *Carbohydr. Polym.*, 5 (1985) 399–406

M. I. Tait, I. W. Sutherland and A. J. Clark-Sturmnan, *Carbohydr. Polym.*, 13 (1990) 133–148

J. D. Stankowski, B. E. Mueller and S. G. Zeller, *Carbohydr. Res.*, 241 (1993) 321–326 each of which and all of which is incorporated herein by reference in its entirety.

Xanthan gum has been used as a rheology modifier in a variety of applications in the past. Whereas it is stable over a wide range of temperatures at neutral pH, a composition containing native xanthan gum, like many other hydrocolloids, undesirably decreases in composition viscosity over time at low pH (less than about 3). The degree to which this decrease occurs is dependent upon factors such as temperature, ionic strength, the pH of the solution and the like.

Without being bound by theory, it is believed that changes at a molecular level occurring under low pH conditions result in a reduction in the native xanthan gum's ability to maintain the viscosity of the acid cleaning composition in which it is employed, and this may eventually lead to product failure so that there is inadequate cleaning. Since many products in which hydrocolloids such as xanthan gum are used comprise acidic pH systems, a solution to this problem is important to businesses and to homeowners and dwellers.

It has now been surprisingly and unexpectedly found that if the acetate content is at or below about 1.2% there is a significant improvement in the viscosity stability of the acidic cleaner composition containing the xanthan gum when employed in acidic environments such as those at relative low pH.

As employed herein, the term "low acetate xanthan gum" means a xanthan gum (or a mixture(s) thereof) having an acetate content of 0 (nonacetylated) or about 0 to about 1.2%, preferably from 0 or about 0 to 1%, and more preferably from 0 or about 0 to about 0.5%. The term "low acetate xanthan gum" also includes those xanthan gums which have been deacetylated to provide an acetate content as recited above. The term "low xanthan gum" as employed herein also includes nonacetylated xanthan gum, which is the preferred low acetate xanthan gum for use in compositions of and method of using this invention.

As used herein, the term "inherently stable" means that the composition of this invention containing low acetate xanthan gum and acid obviates the need for an added stabilizing salt as the viscosity stability, in whole or in part, is provided by the low acetate feature of the xanthan gum. After reading this specification, those of skill in the art will recognize then that for some conditions a stabilizing salt or other stabilizing ingredient may optionally be added to compositions of this invention within the scope of this invention to further enhance the viscosity stability provided by the low acetate feature of the xanthan gum. The initial viscosity is determined closely in time after the acidic cleaning composition is prepared and is termed initial viscosity in that way. Further, as employed herein, the term "inherently stable" acidic cleaning composition means an acidic cleaning composition containing ingredients necessary to achieve the desired effective cleaning effect and exhibiting little decrease (of the order of less than about 20%, for example) or no decrease or an increase in viscosity during storage under normal ambient conditions at a low pH in about 7 days' storage time.

As employed herein, the term "substantially undegraded low acetate xanthan gum" means a low acetate xanthan gum having a viscosifying ability of or similar to that of native xanthan gum prepared under near-optimum commercial conditions. The viscosifying ability is conveniently indicated or measured by the viscosity, measured using a Brookfield viscometer, Model LVT, fitted with a spindle No. 2 (or if necessary, a spindle No. 1] rotating at a speed of 3 revolutions per minute (rpm), of a 0.25% solution of the xanthan gum in an aqueous medium containing 0.1% sodium chloride and 0.0174% calcium chloride dihydrate. For substantially undegraded low acetate xanthan gum, this viscosity is preferably from about 300 to about 3,000 cP (cP=centipoise), more preferably from about 500 to about 2,800 cP, and most preferably from about 1,000 to about 2,500 cP.

Low acetate xanthan gum and certain of its properties have been disclosed in the past. For example, U.S. Pat. No. 3,096,293 to the U.S. Secretary of Agriculture discloses that alkali-deacetylated xanthan gum precipitates more easily with alcohol, has a higher salt sensitivity and forms excellent films, compared to native xanthan gum. U.S. Pat. No. 4,214,912 discloses deacetylated xanthan gum with improved dispersibility prepared by borate treatment of fermentation broth at alkaline pH. U.S. Pat. No. 4,369,125 discloses a gelling composition based on a blend of partially deacetylated xanthan gum and a galactomannan. Native xanthan gum can be deacetylated chemically by a combination of acid and heat, for example, as described in U.S. Pat. No. 4,873,323. Alternatively, it can be deacetylated by exposure to alkaline conditions, as described, for example, in U S. Pat. No. 3,096,293. Each of these United States patents is incorporated herein in its entirety by reference.

One embodiment of this invention includes the use in acidic cleaning compositions of the nonacetylated form of xanthan gum made by certain genetically manipulated strains of Xanthomonas species, which lack the necessary acetyltransferase genes required to transfer these moieties as substituents to the side chains of the xanthan gum molecule.

Many methods for the genetic manipulation of this bacteria have been described (see, for example, U.S. Pat. No. 4,340,678, International Patent Application PCT/US87/00606) which is hereby incorporated in its entirety by reference.

The low acetate xanthan gum is generally provided in the form of a fine milled or granular powder, although a fermentation broth, concentrated fermentation broth, aqueous solution and a slurry in a non-solvent also fall within the scope of this invention. The low acetate xanthan gum may optionally be clarified in order to produce a transparent or translucent acidic cleaning composition. The low acetate xanthan gum may be optionally treated with a minor amount of a cross-linking agent, such as glyoxal, or of another chemical, such as a surfactant or oil, in order to render it more readily dispersible in water, and hence more easy to use in the preparation of acidic cleaning compositions.

The acidic cleaner formulations of the present invention are useful in a wide variety of applications in home, institutional and industrial areas and the like but preferably are useful in the removal of limescale deposits on hard surfaces, such as in cleaning toilet bowls and the like.

Illustratively, non-limiting suitable and compatible acidulents that may be incorporated in the cleaner formulations of the present invention include inorganic acids, such as phosphoric acid, sulphamic acid, hydrochloric acid, muriatic, hydrofluoric, sulfuric, nitric, chromic and mixtures thereof and the like; organic acids, such as acetic acid, hydroxyacetic acid, adipic acid, citric acid, formic acid, fumaric acid, gluconic acid, glutaric acid, glycollic acid, malic acid, maleic acid, lactic acid, malonic acid, oxalic acid, succinic acid and tartaric acid, mixtures thereof and the like; acid salts, such as sodium bisulfate; and mixtures thereof and the like.

The proportions and relative amounts of the acidulent and heteropolysaccharide used in the practice of the present invention may vary according to the actual type of acidulent used, the rheological properties desired and the specific application of the composition. Generally the total acidulent present by weight will comprise from about 0.1% to about 40% and preferably from about 0.5% to about 15%. The most preferable amount depends upon the type of acidulent: for example, with sulphamic acid it is in the range from about 0.2% to about 1%, with hydrochloric acid from about 1% to about 5%, with citric acid from about 2% to about 10%, with formic acid from about 5% to about 15%, and with phosphoric acid from about 5% to about 30% weight. The amount incorporated is generally such that the final pH of the total composition is from about 0 to about 6, or from about 0.5 to about 3. The actual pH and concentration of acidulent used depends upon the type of deposit and the nature of the surface to be cleaned, e.g., glazed ceramic, plastic, enamel, metal, and the like.

The amount of low acetate xanthan gum incorporated in the composition will also vary, depending upon the rheological properties desired for the final acidic cleaning composition product. This may vary from a relatively low viscosity to a thicker consistency approaching that of a gel. Generally, the heteropolysaccharide or low acetate xanthan gum will comprise from about 0.01 (weight) percent to about 5 (weight) percent, and more preferably from about 0.05 weight % to about 2 weight %, even more preferably from about 0.1 weight % to about 1 weight %, and most preferably from about 0.2 weight % to about 0.6 weight %. This will result in a final composition that can be readily applied from a container yet will still flow and adhere to the surface to be cleaned and result in effective cleaning. Those of skill in the art will recognize that various amounts of low acetate xanthan gum may be suitably employed in compositions and method of use of this invention depending on many factors, including the environment, soil to be cleaned, surface to be cleaned, degree of contacting of the cleaning composition with the soil and the like.

Those of skill in the art will recognize that greater or less amounts of low acetate xanthan gum and acidic composition may be employed depend significantly upon the environment of use. This will result in a final composition that can be readily applied from a convenient container yet will still flow well and effectively adhere to the surface to be cleaned and provide the degree of cleaning desired. A beneficial non-wasteful amount of acidic cleaning composition is typically employed in practice. Depending upon the use, illustrative effective, non-wasteful use rates may range from a small amount to a large amount. A typical non-limiting application would be using a squeezable plastic container or the like which dispenses the acidic cleaning composition with ease with a directional nozzle, for example, a spray bottle, or a sponge applicator and the like.

The temperature at which a composition of this invention is typically prepared and/or used is typically ambient or room temperature, although lower or higher temperatures may be employed if desired. The pressure at which a composition of this invention is typically prepared and/or used is typically atmospheric, although pressurized or subatmospheric pressures may be employed if desired.

Preferably, but not required, the acid-based cleaner may optionally also include a surface-active agent, or surfactant, to further aid in the removal of soil or to provide foam or wetting characteristics or to increase the cleaning effectiveness of the composition. The surfactant is preferably an anionic or non-ionic surfactant.

Acceptable non-limiting anionic surfactants may or can be from any of the following anionic types: linear alkyl benzene sulphonates, alkyl sulphonates, alkyl ether sulphates, alcohol sulphates or phosphate esters and mixtures thereof and the like.

Acceptable non-limiting non-ionic surfactants may or can be from any of the following non-ionic types: alcohol ethoxylates, alkyl phenol ethoxylates, fatty acid ethoxylates, fatty amine exthoxylates, polyproylene glycol ethoxylates, alkyl polyglucosides, amine oxides alkanoamides and mixtures thereof and the like.

Cationic surfactants may optionally be included in order to provide germicidal properties to the cleaner if desired. One of skill in the art will recognize that amphoteric surfactants may also be used. Mixtures of various surfactants can be employed, if desired.

Compositions of this invention for cleaning soils (one material on another, such as scum, spots, deposits, crud, stains, grime, etc.) comprise xanthan gum, acid cleaner(s), optional ingredients as recited herein with the remaining (major) balance water.

The acidic cleaning composition may optionally also contain a preservative to prevent spoilage due to the growth of microorganisms in the product, a colorant, a perfume to enhance the consumer appeal of the product and provide a pleasant odor during and after application of the cleaner, and/or an abrasive to facilitate the removal of soil from the surface to be cleaned. An additional benefit is that the rheological properties conferred by the low acetate xanthan gum will assist in preventing sedimentation of any abrasive particles during the shelf-life of the cleaner. If desired, other additives may be employed with compositions of this invention as will be easily determined by those of skill in the art after reading this specification.

In use, the acidic cleaning composition of this invention may be filled or poured into a bottle, trigger-pack or other suitably convenient container and thereafter applied to the soiled surface through an opening in the container, such as a spout, nozzle or spray device that facilitates uniform distribution onto easy-, moderate- and hard-to-reach surfaces. The viscosity is such as to readily enable rinsing off the surface with water or wiping the surface with a sponge or cloth after the cleaning effect has been achieved so it is complete. An illustrative use of a composition of this invention is the cleaning of a toilet bowl wherein an effective amount of a composition of this invention is poured onto a soil in the toilet bowl. The soil is then allowed to soak for a time sufficient for the cleaning composition to work effectively and the area thereby treated is rinsed with water to complete the cleaning. A more particular illustrative use of a composition of this invention is the cleaning of a toilet bowl wherein an effective amount of a composition of this invention is squirted from the nozzle of a squeezable plastic bottle having a directable neck under and around the rim of a toilet bowl, from where it flows down towards the water level, coating the wall of the bowl, and is then, after a period of time ranging from one or two minutes to several hours, rinsed away by flushing the toilet to complete the cleaning action. Those of skill in the art will appreciate that any convenient, effective means may be employed for providing a effective cleaning amount of acidic cleaning composition to the soiled surface to be cleaned.

The following examples are provided merely to better define and more specifically describe the teachings and embodiments of the present invention. They are for illustrative purposes only, and it is recognized that changes and/or alterations might be made that are not immediately disclosed therein. It is to be understood that, to the extent that any such changes do not materially alter the final product or its functionality or its use, they are considered as falling within the spirit and scope of the invention as defined by the claims that follow thereafter.

EXAMPLE 1

The viscosity stability of acidic cleaning compositions containing xanthan gum may be determined and defined in terms of its degree of viscosity over time. The degree of stability of an acidic cleaning composition containing low acetate xanthan gum (acetate content 0.6%, viscosity 1,060 cP (cP=centipoise) at 0.25% and 3 rpm was compared to that of an acidic cleaning composition containing native xanthan gum (acetate content 5.6%, viscosity 1080 cP at 0.25% and 3 revolutions per minute) when used as a rheology modifier in an acidic composition in an acid environment. No auxiliary stabilizing salt was employed. No surfactant was employed. All percents are by volume throughout the Examples and specification unless otherwise noted.

Comparative stability tests were conducted using compositions comprising 0.5% low acetate xanthan gum or native xanthan gum, together with 4% citric acid, 2% sulphamic acid and 5% hydrochloric acid. The gum was first dissolved in water which was stirred at 800 rpm for 90 minutes. The amounts of acid and preservative (0.1% BRONIDOX®L preservative, 5-Bromo-5-Nitro-1,3-Dioxane as a 10% solution in 1,2-Propylene Glycol; a registered trademark of Henkel Corporation, Ambler, Pennsylvania and marketed by Henkel Limited, 292–308 Southbury Road, Enfield, Middlesex, EN1 1TS, United Kingdom) were added and these compositions were then stirred for another 30 minutes. The initial viscosity of the acidic composition was measured using a Brookfield LVT viscometer at a spindle speed of 0.6 rpm. The solutions were poured into glass bottles and incubated at 25° C. The viscosity of each solution was measured after 1 and 7 days. Table 1 shows the viscosity of each solution at each stage.

TABLE 1

Viscosity Stability Over Time of Acidic Cleaning Compositions Containing Low Acetate Xanthan Gum Using Various Acids

| | Brookfield Viscosity (cP) at 0.6 rpm after: | | | |
|---|---|---|---|---|
| Test Solution | Initial | 1 Day | 7 Days | pH |
| 0.5% Low acetate xanthan gum + 4% citric acid | 10,450 | 10,750 | 10,000 | 2.2 |
| 0.5% Native xanthan gum + 4% citric acid | 9,400 | 9,900 | 6,850 | 2.2 |
| 0.5% Low acetate xanthan gum + 2% sulphamic acid | 4,700 | 5,650 | 6,300 | 1.5 |
| 0.5% Native xanthan gum + 2% sulphamic acid | 3,790 | 2,720 | 1,080 | 1.5 |
| 0.5% Low acetate xanthan gum + 5% hydrochloric acid | 3,550 | 5,750 | 6,350 | 0.5 |
| 0.5% Native xanthan gum + 5% hydrochloric acid | 3,530 | 6,250 | 1,950 | 0.5 |

After seven days' storage, the viscosity value of the three acidic compositions containing low acetate xanthan gum had all either remained steady or increased while those containing native xanthan gum had decreased. The higher increased viscosity values after 7 days of compositions illustrative of this invention are a direct indication of viscosity stability and improved product performance with low acetate xanthan gum.

EXAMPLE 2

Acidic cleaning compositions of the present invention have improved viscosity stability, even at elevated temperatures. An acidic cleaning composition, comprising 0.5% low acetate xanthan gum (acetate content 0.6%; solution viscosity 1,440 cP at 0.25% and three revolutions per minute), 4% citric acid, 2% ethoxylated alcohol (surfactant), fragrance and color was prepared which illustrates this invention. The cleaner composition was stored at three different temperatures: 25°, 35° and 55° C. The Brookfield viscosity at a spindle speed of 0.6 rpm was measured at 25° C. after 0, 1 and 7 days' storage after adjusting the temperature to 25° C. No auxiliary stabilizing salt was employed.

TABLE 2a

Acidic Cleaning Composition Containing Low Acetate Xanthan Gum Stored At Different Temperatures

| Storage | Brookfield Viscosity at 0.6 rpm (cP) at 25° C. After: | | |
|---|---|---|---|
| Temperature | Initial | 1 Day | 7 Days |
| 25° C. | 13,550 | 16,750 | 15,800 |
| 35° C. | 13,550 | 16,100 | 15,700 |
| 55° C. | 13,550 | 15,300 | 13,000 |

For comparison, acidic cleaning compositions were prepared using native xanthan gum (acetate content about 5%, solution viscosity 1,120 cP at 25° C.) and three revolutions per minute in place of low acetate xanthan gum and are shown in Table 2b immediately below.

TABLE 2b

| Acidic Cleaning Compositions Containing Native Xanthan Gum Stored At Different Temperatures | | | |
|---|---|---|---|
| Storage | Brookfield Viscosity at 0.6 rpm (cP) at 25° C. After: | | |
| Temperature | Initial | 1 Day | 7 Days |
| 25° C. | 13,350 | 12,600 | 8,750 |
| 35° C. | 13,350 | 11,500 | 6,000 |
| 55° C. | 13,350 | 7,600 | 2,330 |

The results in Tables 2a and 2b show that, after seven days' storage, the viscosity of the cleaner composition containing low acetate xanthan gum stored at the elevated temperature of 55° C. is greater than that of the comparable cleaning composition containing native xanthan gum stored at 25° C. This indicates the improved acid stability of low acetate xanthan gum compositions compared to native xanthan gum compositions.

EXAMPLE 3

Three samples of partially deacetylated xanthan gum were prepared with acetate contents of 2%, 1.4% and 0.5% acetate, respectively. Test solutions of these three samples and one of native xanthan gum were prepared, each containing 4% citric acid and 0.1% BRONIDOX®L preservative, 5-Bromo-5-Nitro-1,3-Dioxane as a 10% solution in 1,2-Propylene Glycol, a registered trademark of Henkel Corporation, Ambler, Pennsylvania and marketed by Henkel Limited, 292–308 Southbury Road, Enfield, Middlesex, EN1 1TS, United Kingdom. The test acidic compositions containing these three samples and one of native xanthan gum were stored for 70 days at 25° C. and the Brookfield viscosities were measured at a spindle speed of 0.6 rpm after 0 (initially after preparation), 7 and 70 days. The results are shown in Table 3. No auxiliary stabilizing salt was employed. No surfactant was employed.

TABLE 3

| Viscosity Stability of Acidic Compositions Containing Xanthan Gum With Differing Acetate Content | | | |
|---|---|---|---|
| | Brookfield Viscosity (cP) at 0.6 rpm After: | | |
| Xanthan Gum | Initial | 7 Days | 70 Days |
| Native | 9,400 | 6,850 | 2,800 |
| 2% Acetate | 5,600 | 4,400 | 2,170 |
| 1.4% Acetate | 7,200 | 6,050 | 3,840 |
| 0.5% Acetate | 9,450 | 9,550 | 9,500 |

A reduction in acetate content improves the acidic composition viscosity retention. The results indicate that acidic compositions using xanthan gum with an acetate content below about 1.4% as the rheological modifier control agent possess substantially greater shelf life stabilities than those known in the art, remaining stable for periods of over seventy days.

EXAMPLE 4

By alkaline deacetylation, a sample of xanthan gum (A) was prepared, which had an acetate content of 1% and a solution viscosity of 1,110 cP at 0.25% and 3 rpm. By fermentation, samples of non-acetylated xanthan gum (B, C and D) were prepared, which had solution viscosities of 1,400, 1,640 and 2,300 cP, respectively, at 0.25% and 3 rpm. A native xanthan gum sample (E) was also taken; this had a solution viscosity of 1,120 cP at 0.25% and 3 rpm.

Test acidic compositions were prepared containing 0.4% xanthan gum (sample A, B, C, D or E), 4% citric acid and 0.1% BRONIDOX®L. These were stored for 28 days at a temperature of 25° C. After 1 and 28 days, the viscosity of each test composition was measured using a Brookfield LVT viscometer at spindle speeds of 60, 6 and 0.6 rpm. The results are shown in Table 4.

TABLE 4

| Acidic Compositions Containing Various Xanthan Gum Samples | | | | |
|---|---|---|---|---|
| Xanthan Gum | Storage | Viscosity (cP) at: | | |
| Sample | Time (Days) | 60 rpm | 6 rpm | 0.6 rpm |
| A | 1 | 310 | 1,480 | 6,000 |
| A | 28 | 290 | 1,570 | 7,000 |
| B | 1 | 270 | 1,370 | 5,700 |
| B | 28 | 280 | 1,515 | 6,500 |
| C | 1 | 260 | 1,330 | 6,200 |
| C | 28 | 280 | 1,550 | 7,300 |
| D | 1 | 370 | 2,000 | 10,700 |
| D | 28 | 370 | 2,200 | 12,300 |
| E | 1 | 230 | 1,230 | 6,300 |
| E | 28 | 195 | 670 | 1,390 |

The results show that acidic compositions containing substantially undegraded low acetate xanthan gum with an acetate content of about 1% are inherently stable. The results further show that acidic compositions containing substantially undegraded low acetate xanthan gum with zero acetate content (nonacetylated) are inherently stable.

The results show that acidic compositions containing substantially undegraded native xanthan gum are not inherently stable. Although the results of viscosity measurements made at a spindle speed of 60 rpm might lead to the opposite conclusion, the results at spindle speeds of 6 and 0.6 rpm on the Brookfield viscometer, which correspond to lower shear rates and which are believed to be significant in controlling flow on inclined surfaces, show that these acidic compositions are not inherently stable.

EXAMPLE 5

A sample (F) of xanthan gum was prepared by treatment of fermentation broth with hydrochloric acid under cold conditions, according to Research Disclosure 36151 (May 1994, page 271). This had an acetate content of 3.2% and a solution viscosity of 210 cP at 0.25% and 3 rpm. A control sample (G) of xanthan gum was prepared from the same fermentation broth without treatment with hydrochloric acid and without heat treatment. This had an acetate content of 5.9% and a solution viscosity of 410 cP at 0.25% and 3 rpm.

Test acidic compositions containing 0.4% xanthan gum (F or G) and 10% formic acid were prepared. These were stored at 25° C. The viscosities were measured after 1 day and 28 days using a Brookfield LVT viscometer at a spindle speed of 6 rpm. Results are shown in Table 5.

TABLE 5

Acidic Compositions Containing Pre-degraded Xanthan Gum and Native Xanthan Gum

| Xanthan Gum | Storage Time (Days) | Viscosity (cP) at 6 rpm |
|---|---|---|
| F | 1 | 240 |
| F | 28 | 200 |
| G | 0 | 580 |
| G | 28 | 350 |

The acidic composition containing xanthan gum sample F is viscosity stable. However, the actual viscosity value (240 to 200 cP) is much lower than that of, for example, the acidic composition containing the substantially undegraded xanthan gum sample A shown in Table 4 (1,480 to 1,570 cP at the same concentration and spindle speed). It is believed that this difference is not attributable to the use of a different acid, since formic acid is only slightly stronger than citric acid. Rather, it is believed that the lower viscosity value is due, at least in part, to the fact that sample F had been partially degraded during its preparation. This is evident from the fact that its solution viscosity of 210 cP at 0.25% and 3 rpm is approximately half that of the control sample G.

Although the analysis of xanthan gum sample F showed it to have been partially deacetylated during preparation, the viscosity stability exhibited by the acidic composition of this Example could not obviously be ascribed to this fact. An acidic composition containing a substantially undegraded xanthan gum having the same acetate content as sample F would normally be assumed to exhibit a decrease in viscosity on storage. The results shown in Example 3, by interpolation, justify this assumption. Without being bound by theory, it appears most likely that the viscosity stability results from xanthan gum sample F having already been partially degraded by acid during the course of its preparation; consequently it would be reasonable to expect that it would not be degraded significantly further when incorporated in the acidic composition of Example 5.

An acidic cleaner composition containing xanthan gum sample F does not fall within the scope of the present invention.

The results in Table 5 show that acidic compositions containing the native xanthan gum sample G are not inherently stable. Although sample G had a relatively low solution viscosity (410 cP at 0.25% and 3 rpm), it should be regarded as substantially undegraded. The reason for its relatively low solution viscosity is that the fermentation broth had not been subjected to the heat treatment process which is generally applied prior to precipitation in order to increase the viscosifying power of xanthan gum.

EXAMPLE 6

Test acidic compositions containing 4% citric acid and different concentrations of either low acetate or native xanthan gum (both substantially undegraded) were prepared. These were stored at 25° C. and the viscosity was measured after 90 days using a Brookfield viscometer at 0.6 rpm.

TABLE 6

Acidic Compositions Containing Different Concentrations of Low Acetate and Native Xanthan Gum

| Xanthan Gum Type | Xanthan Gum Concentration | Viscosity (cP) at 0.6 rpm after 90 days |
|---|---|---|
| Low acetate | 0.2% | 690 |
| Native | 0.2% | <100 |
| Low Acetate | 0.3% | 2,700 |
| Native | 0.3% | 360 |
| Low Acetate | 0.4% | 9,000 |
| Native | 0.4% | 1,000 |
| Low Acetate | 0.5% | 11,800 |
| Native | 0.5% | 3,300 |
| Low Acetate | 0.6% | 22,200 |
| Native | 0.6% | 5,000 |

From the above results, it is apparent that to achieve a certain viscosity value in an acidic composition which is stored prior to use low acetate xanthan gum can be employed at a significantly lower concentration than native xanthan gum. For example, to formulate a composition containing 4% citric acid and having a Brookfield viscosity at 0.6 rpm of 5,000 cP after 90 days' storage, a concentration between 0.3 and 0.4% of low acetate xanthan gum is required, compared to 0.6% of the native xanthan gum.

EXAMPLE 7

Low acetate xanthan gum powder was added to water while stirring well to form an initial dispersion. The dispersion was stirred until a fully hydrated xanthan solution was achieved. A non-ionic surfactant (e.g., ethoxylated alcohol) was added, followed by color, perfume, preservative and finally sulphamic acid. This mixture was mixed until a homogeneous solution was achieved.

The above Example provided a typical toilet bowl cleaner based on sulphamic acid and was prepared by a preferred order of ingredients. This composition was then effectively used to clean a toilet bowl.

Thus, it is apparent that there has been provided, in accordance with the instant invention, a composition and method of use that fully satisfies the objects and advantages set forth herein above. While the invention has been described with respect to various specific examples and embodiments thereof, it is understood that the invention is not limited thereto and many alternatives, modifications and variations will be apparent to those skilled in the art in light of the foregoing description. Accordingly, it is intended to embrace all such alternatives, modifications and variations as fall within the spirit and broad scope of the invention.

What is claimed is:

1. An inherently stable acidic cleaning composition consisting essentially of an acid and a low acetate xanthan gum as a rheology modifier therewith.

2. The acidic cleaning composition of claim 1 wherein said low acetate xanthan gum is substantially undegraded and has an acetate content from 0 to about 1.2%.

3. The acidic cleaning composition of claim 2 wherein said substantially undegraded low acetate xanthan gum has an acetate content from 0 to about 1% and a solution viscosity at 0.25% and 3 rpm greater than about 500 cP.

4. The acidic cleaning composition of claim 3 wherein said substantially undegraded low acetate xanthan gum has an acetate content from 0 to about 0.5% and a solution viscosity at 0.25% and 3 rpm greater than about 1,000 cP.

5. The acidic cleaning composition of claims 1, 2, 3 or 4 wherein said acid is selected from the group consisting of inorganic acids, organic acids and mixtures thereof.

6. The acidic cleaning composition of claim 5 wherein said inorganic acid is selected from the group consisting of phosphoric acid, sulphamic acid, hydrochloric acid, hydrofluoric, sulfuric, nitric, chromic and mixtures thereof.

7. The acidic cleaning composition of claim 5 wherein said organic acid is selected from the group consisting of acetic acid, hydroxyacetic acid, adipic acid, citric acid, formic acid, fumaric acid, gluconic acid, glutaric acid, glycollic acid, malic acid, maleic acid, lactic acid, malonic acid, oxalic acid, succinic acid and tartaric acid, and mixtures thereof.

8. The acidic cleaning composition of claim 2 wherein said acid is incorporated in said cleaning composition in an amount sufficient to maintain the pH of the composition in the range of from about 0 to about 6.

9. The acidic cleaning composition of claim 8 wherein said acid is incorporated in said cleaning composition in an amount to maintain the pH of the composition in a range from about 0.5 to about 3.

10. The acidic cleaning composition of claim 9 wherein said substantially undegraded low acetate xanthan gum is incorporated in an amount of from about 0.01 weight % to about 5 weight %.

11. The acidic cleaning composition of claim 9 wherein said substantially undegraded low acetate xanthan gum is incorporated in an amount of from about 0.05 weight % to about 2 weight %.

12. The acidic cleaning composition of claim 9 wherein said substantially undegraded low acetate xanthan gum is incorporated in an amount of from about 0.1 weight % to about 1 weight %.

13. The acidic cleaning composition of claim 12 further consisting essentially of at least one of a surfactant, colorant, abrasive, perfume, preservative and mixtures thereof.

14. The acidic cleaning composition of claim 13 wherein said surfactants are selected from the group consisting of anionic surfactants, non-ionic surfactants and mixtures thereof.

15. The acidic cleaning composition of claim 14 useful as a toilet bowl, bath and sink, and kitchen cleaner.

16. An inherently stable acidic cleaning composition comprising an acid and a low acetate xanthan gum as a rheology modifier therewith, wherein said composition is free of stabilizing salts.

17. An inherently stable acidic cleaning composition consisting essentially of an acid and a low acetate xanthan gum as a rheology modifier with improved viscosity stability, whereby the viscosity of said acidic cleaning composition is maintained at about 20% of its initial viscosity after about 7 days at room temperature.

18. The acidic cleaning composition of claim 16 wherein said low acetate xanthan gum is substantially undegraded.

19. A process for effectively cleaning a soiled surface which comprises applying an effective soil-removing amount of an inherently stable acidic cleaning composition consisting essentially of an acid and a low acetate xanthan gum as a rheology modifier to said surface for an effective time whereby said soil is removed in part or whole from said surface to provide a cleaned surface.

20. The process of claim 18 wherein said low acetate xanthan gum has an acetate content of 0 to about 1%.

21. The process of claim 19 wherein said acetate content is from 0 to about 0.5%.

* * * * *